US007779590B2

(12) United States Patent
Hsu et al.

(10) Patent No.: US 7,779,590 B2
(45) Date of Patent: Aug. 24, 2010

(54) COMPOSITE FLOOR SYSTEM HAVING SHEAR FORCE TRANSFER MEMBER

(75) Inventors: Cheng-Tzu Thomas Hsu, Hazlet, NJ (US); Sun Punarai, Newark, NJ (US); Pedro R. Munoz, Newburyport, MA (US)

(73) Assignee: New Jersey Institute of Technology, Newark, NJ (US)

( * ) Notice: Subject to any disclaimer, the term of this patent is extended or adjusted under 35 U.S.C. 154(b) by 372 days.

(21) Appl. No.: 11/820,250

(22) Filed: Jun. 19, 2007

(65) Prior Publication Data

US 2008/0000178 A1 Jan. 3, 2008

Related U.S. Application Data

(60) Provisional application No. 60/815,340, filed on Jun. 20, 2006.

(51) Int. Cl.
*E04B 5/17* (2006.01)
*E04B 5/18* (2006.01)
*E04B 5/40* (2006.01)

(52) U.S. Cl. ..... 52/334; 52/328; 52/335; 52/414

(58) Field of Classification Search ..... 52/414, 52/432, 328, 334, 336, 335, 340, 341
See application file for complete search history.

(56) References Cited

U.S. PATENT DOCUMENTS

| | | | | | |
|---|---|---|---|---|---|
| 1,574,328 | A | * | 2/1926 | White | 52/370 |
| 1,768,626 | A | * | 7/1930 | Pedersen | 52/333 |
| 1,974,730 | A | * | 9/1934 | Zollinger | 52/334 |
| 2,340,176 | A | * | 1/1944 | Cueni et al. | 52/334 |
| 2,479,475 | A | * | 8/1949 | Cueni | 52/334 |
| 2,945,328 | A | * | 7/1960 | Webb | 52/327 |
| 3,177,619 | A | * | 4/1965 | Benjamin | 52/332 |
| 3,251,167 | A | | 5/1966 | Curran | |
| 3,596,421 | A | * | 8/1971 | Miller | 52/333 |
| 3,956,864 | A | * | 5/1976 | Fung | 52/414 |
| 4,106,249 | A | * | 8/1978 | Morton | 52/336 |
| 4,457,115 | A | * | 7/1984 | Grearson et al. | 52/73 |
| 4,566,240 | A | | 1/1986 | Schilger | |
| 4,602,467 | A | | 7/1986 | Schilger | |
| 4,715,155 | A | * | 12/1987 | Holtz | 52/333 |
| 4,729,201 | A | | 3/1988 | Laurus et al. | |
| 4,741,138 | A | * | 5/1988 | Rongoe, Jr. | 52/334 |
| 4,885,884 | A | | 12/1989 | Schilger et al. | |
| 4,930,278 | A | | 6/1990 | Staresina et al. | |

(Continued)

FOREIGN PATENT DOCUMENTS

| | | |
|---|---|---|
| CA | 2030101 | 7/2000 |

OTHER PUBLICATIONS

Hambro literature, four (4) pages.

(Continued)

*Primary Examiner*—Robert J Canfield
(74) *Attorney, Agent, or Firm*—McCarter & English, LLP

(57) ABSTRACT

A system and method of constructing a composite floor system having increased shear transfer between a slab and support members of the system is described. The composite floor system may include any combination of the following elements: a support member, a reinforcing member, a transfer member, a decking material, a fastener, and/or a slab.

15 Claims, 12 Drawing Sheets

U.S. PATENT DOCUMENTS

| | | | | |
|---|---|---|---|---|
| 5,367,848 | A * | 11/1994 | McConnohie | 52/336 |
| 5,390,457 | A * | 2/1995 | Sjolander | 52/387 |
| 5,414,972 | A | 5/1995 | Ruiz et al. | |
| 5,544,464 | A * | 8/1996 | Dutil | 52/330 |
| 6,216,414 | B1 * | 4/2001 | Feldberg | 248/525 |
| 6,289,647 | B1 * | 9/2001 | Sjolander | 52/510 |
| 6,708,459 | B2 | 3/2004 | Bodnar | |
| 6,729,094 | B1 * | 5/2004 | Spencer et al. | 52/414 |
| 7,013,613 | B1 * | 3/2006 | Boellner et al. | 52/837 |
| 2004/0065043 | A1 * | 4/2004 | Foderberg et al. | 52/630 |
| 2005/0120668 | A1 | 6/2005 | Hage-Chahine et al. | |

OTHER PUBLICATIONS

PCT International Search Report dated Aug. 1, 2008.

Metal Stud Crete, *Composite Concrete Panel System—Quality Control and Fabrication Manual*, Jun. 17, 2001, pp. 1-18.

* cited by examiner

COMPOSITE FLOOR SYSTEM HAVING SHEAR FORCE TRANSFER MEMBER

CROSS-REFERENCE TO RELATED APPLICATION

This application claims the benefit of U.S. Provisional Patent Application No. 60/815,340 filed Jun. 20, 2006, the disclosure of which is incorporated herein by reference in its entirety.

FIELD OF THE INVENTION

The present invention relates to the field of composite floor systems. More particularly, it refers to a system and method of constructing a composite floor system having increased shear transfer between a slab and support members of the system. Further, some embodiments of the system and method herein described may allow for an increased load carrying capacity, an increased resistance to deflection, an increased ductility, and increased potential energy absorption. In an embodiment, a design of described system may reduce a weight of the system while maintaining strength and ductility of the composite floor system. Thus, the composite floor system described is lightweight and ductile. Further, the system and method described may allow for components of the composite floor system to be pre-fabricated off-site. In addition, an embodiment of composite floor system may use commonly available tools, materials, and construction methods to reduce a construction cost for the system and method.

BACKGROUND OF THE INVENTION

"Composite floor system" refers to a system that encompasses the use of multiple materials in the construction process of a floor system. Composite floor systems are designed to allow transfer of shear forces between the component parts of the deck and the supporting floor joists. Many composite floor systems combine wood, concrete and/or metals (e.g., steel).

Composite floor systems are commonly used in the construction of low-rise multifamily housing, commercial, mixed use developments or hospitality projects. Composite floor systems are designed to allow the component parts to act in conjunction with each other to increase the load capacity of the system and reduce the total deflection under load. Concrete-steel composite floor systems are preferred in construction projects, where wood is scarce. The abundance of wood in North America has made wood the traditional floor material in both the United States and Canada.

Non-composite floor systems may require an increase in material and size to provide the same load carrying capacity of a composite floor system. Due to this increased strength relative to non-composite floor systems, composite floor systems are utilized in areas subject to heavy floor loads and where significant unanticipated forces, for example, areas prone to natural disasters (e.g., earthquakes) and military installations.

Current building technology includes many configurations for these composite floor systems. FIG. 1 and FIG. 2 depict views of non-composite floor systems. FIG. 1 illustrates a top view of a non-composite floor system, which includes a decking material D and fasteners F. FIG. 2 depicts a cross-sectional side view of a non-composite floor system, which includes the decking material D, a reinforcing member R, a slab S, and a beam B.

Traditional composite floor systems require decking, which are often limited to one particular type. Further, many currently available floor systems use discontinuous slabs of concrete due to design constraints. In addition, traditional composite floor systems generally require use of significant temporary formwork. In some instances, traditional composite floors may use complicated shear connectors to foster composite action from the component parts of the composite floor. These complicated shear connectors increase cost and may significantly affect installation requirements and time, which in turn translates into higher construction costs per square foot of installed floor.

The presently disclosed novel apparatus and method of use of the apparatus contain all of the same advantages present in the traditional technique but eliminate the associated disadvantages.

SUMMARY OF THE INVENTION

A composite floor system and method of construction thereof are herein described. The method and system described may allow components of the system to be assembled prior to delivery to the work site. Thus, the design of the composite floor system may facilitate a reduced assembly time on-site and reduce costs of construction. The design of the composite floor system described herein may further decrease costs associated with assembling the composite floor system on-site by the use of common tools, construction methods, and lightweight materials that can be easily transported around the job site.

A method of constructing a composite floor system as herein described may include assembling one or more components prior to delivery to the site. For example, a decking material may arrive on a construction site coupled to a transfer member. This may reduce building costs on-site as well as provide for a more stable system.

A composite floor system embodiment includes lightweight materials, which may be easily fabricated and are economical. In addition, a lightweight composite floor system may be easier to handle and transport. In some embodiments, the composite floor system and method of construction described herein may minimize the need for sophisticated quality control measures to achieve a desired or intended load capacity.

In an embodiment, the composite floor system may include any combination of the following elements: a support member, a reinforcing member, a transfer member, a decking material, a fastener, and/or a slab. In alternate embodiments, elements of the composite floor system may vary. In addition, the system and the component parts may be installed easily with readily available hardware and tools.

A lightweight composite floor system, as described herein, may serve as an alternative to wood-based floor systems. The composite floor system described may provide for a greater structural strength and a higher fire-rating than a wood-based system. In addition, the composite floor system may provide better soundproofing than a wood-based system. Further, the composite floor system and method described herein would also serve as an alternative to other steel based composite floor systems. The floor system described herein may have a lower material cost per square foot than non-composite floor systems and reduce a profile of the composite floor, thus reducing the height of the floor. Further, a transfer member described herein may increase the overall stability of the composite floor system when compared to wood-based, traditional steel-based, non-composite floor systems, or traditional composite floor systems.

Further, the system described may have an increased load carrying capacity, an increased resistance to deflection, increased ductility, and an increase in potential energy absorption of the system relative to non-composite floor systems and/or traditional composite floor systems. In some embodiments, the design of the described system may reduce weight of the system while maintaining strength of the composite floor system. Thus, the composite floor system described is lightweight. Further, the system and method described may allow for components of the composite floor system to be pre-fabricated off-site. An embodiment of composite floor system may use commonly available tools and construction methods to reduce a construction cost for the system and method.

In one embodiment, the composite floor system includes a slab, a deck material sized and shaped to support the slab, a support member attached to the deck material, and a transfer member, such as a shear connector. The transfer member is attached to the support member. The transfer member includes an elongated body having a bottom with a pair of opposing edges, an open top opposite the bottom, and side walls extending upwardly from each edge. The transfer member is adapted to increase transfer of shear forces between the slab and the support member.

In another embodiment, the composite floor system includes a slab, a deck material sized and shaped to support the slab, a support member attached to the deck material, and a transfer member attached to the support member. The support member includes a first beam with a first side wall having a first top edge and a first bottom edge. The first beam includes a first flange extending from the first top edge of the first side wall. The support member also includes a second beam with a second side wall having a second top edge and a second bottom edge. The second beam includes a second flange extending from the second top edge of the second side wall. The first side wall is positioned proximate the second side wall.

These and other advantages, features and attributes of the herein described composite floor system and its advantageous applications and/or uses will be apparent from the detailed description which follows, particularly when read in conjunction with the figures appended hereto.

BRIEF DESCRIPTION OF THE DRAWINGS

To assist those of ordinary skill in the relevant art in making and using the subject matter hereof, reference is made to the appended drawings, wherein.

DETAILED DESCRIPTION OF THE INVENTION

A composite floor system may include two or more components to allow for transfer of shear forces between the component parts. In some embodiments, multiple components may act as a unified object. Components used in the composite floor system may include lightweight materials, to decrease a total weight of the system while maintaining the strength and durability of the floor system.

Figure 1:
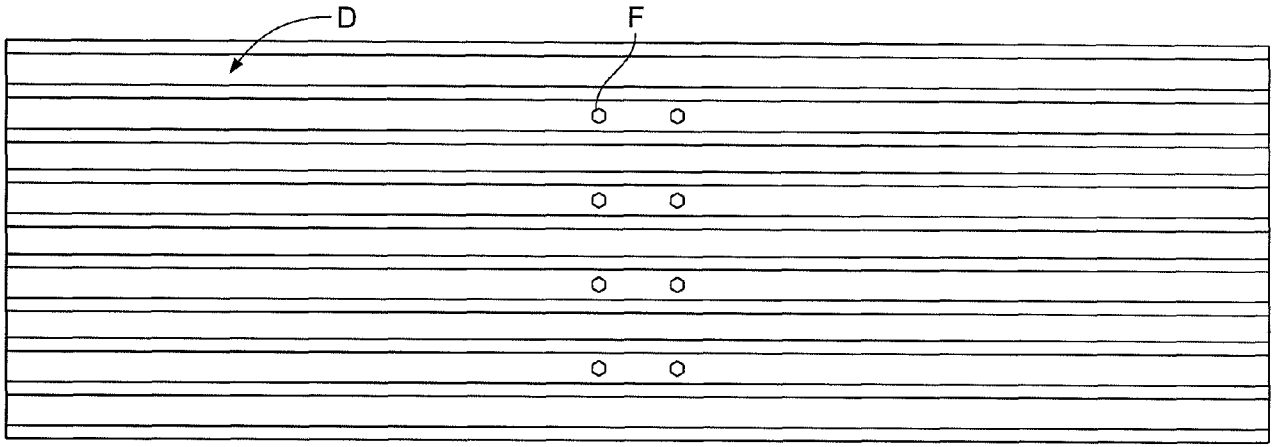
FIG. 1 (Prior Art)
FIG. 1 depicts a top view of a non-composite floor system.
Figure 2:
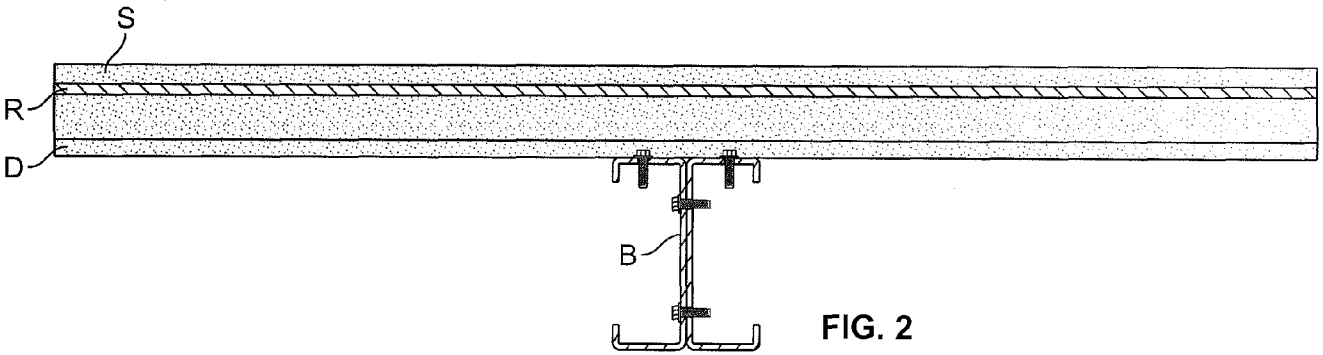
FIG. 2 (Prior Art)
FIG. 2 depicts a cross-sectional side view of a non-composite floor system.
Figure 3:
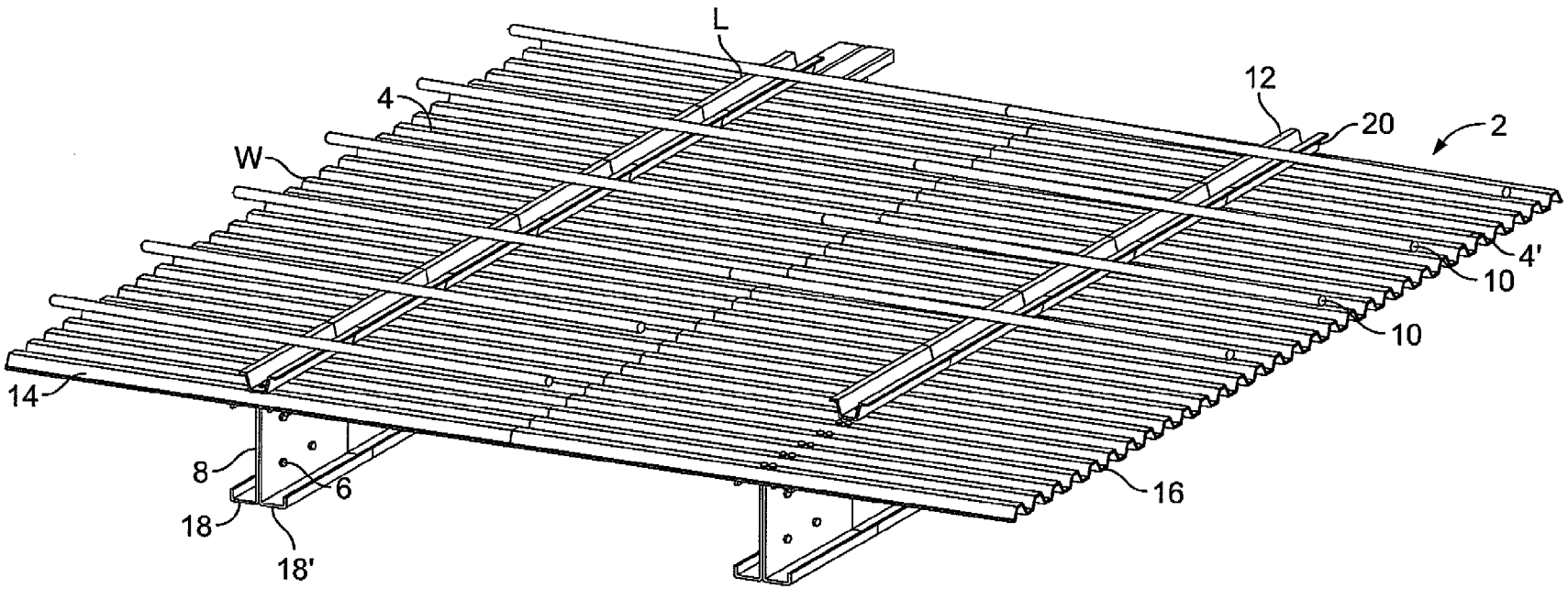
FIG. 3 depicts a perspective view of an embodiment of a composite floor system.

FIG. 3 depicts an embodiment of composite floor system 2 prior to the addition of a slab. In this embodiment, composite floor system 2 includes decking material 4, 4' fasteners 6, support members 8, reinforcing members 10, transfer members 12, and a slab (not shown).

Decking material 4 may include various materials including, but not limited to wood, plywood, fiberboard, metal, corrugated sheet metal, sheet metal (e.g. cold form steel), pre-cast concrete materials, gypsum, GYP-CRETE® underlayment, gypsum-metal composites, backer boards, rubber padding, fiberglass, polymer sheets, foam-core panels, and/or any combination thereof. In some embodiments, the decking material may have a rough surface. In alternate embodiments, a surface of the decking material may be relatively smooth or have a smooth surface.

Decking material 4 may have any thickness, weight, and shape. In some embodiments, the weight of decking material 4 may be minimized in order to minimize the weight of the composite floor system. As shown in FIG. 3, decking material 4 is a corrugated sheet metal having peaks 14 and valleys 16. Decking material 4 may be used to support the slab.

Fasteners 6 are used to couple the component parts. FIG. 3 depicts fasteners 6 coupling two beams 18, 18' to form support member 8. Fasteners may include, but are not limited to screws, rivets, welds, bolts, anchors, clips, straps, wires, cables, adhesives, and/or any method of coupling known in the art. Fasteners may be coupled to transfer members, support members and/or decking materials using any fastening systems including, but not limited to a nail gun or any type of power actuated fastener installer hardware machine. For example, a metal deck fastening system from Hilti corporation (Tulsa, Okla.) may be used.

As shown in FIG. 3, support member 8 includes two C-beams 18, 18' coupled together. Beams used as support members may have any cross-sectional geometry. In another embodiment, support members may be constructed from one or multiple materials including, but not limited to metals (e.g., light-gauge steel, cold-formed steel, aluminum, alloys), fiberglass, engineered lumber, composites, concrete, reinforced concrete, wood, and/or masonry. Further, support members may include, but are not limited to, one beam (e.g., an I-beam, a C-beam, an X-beam, a V-beam, a T-beam, an L-beam, a Z-beam, a hollow structural beam or any other shape that may be configured to act as a main supporting beam), a coupling of multiple beams, girders, joists, studs, trusses, walls (e.g., concrete walls, masonry walls), and/or any combination thereof. Support members may be solid or, in some embodiments, the support member may have openings to reduce its weight. An embodiment of a support member may be constructed to withstand high compressive forces. For example, a support member may be designed to deform under a compressive force to prevent buckling.

As illustrated in FIG. 3, reinforcing members 10 are reinforcement bars (e.g., "rebars"). In some embodiments, reinforcing members include, but are not limited to bars, grids, fibers, and/or cables. Reinforcing members may be constructed from materials including, but not limited to steel, plastics (e.g., fiber-reinforced plastics), composites, fiberglass, and/or any other type of tensile reinforcing material. In some embodiments, the reinforcing members may be placed proximate the transfer member and/or the decking material. Alternatively, one or more of the reinforcing members may be coupled to the transfer member and/or the decking material.

Composite floor system 2 includes transfer member 12 having transfer member flanges 20. Transfer members 12 may be formed from any material including, but not limited to metals (e.g., light gauge steel, cold-form steel, alloys, etc.), polymers, composites, and/or any combination thereof. In some embodiments, transfer members 12 may be formed from sheet materials. In alternate embodiments, transfer members 12 may be formed using an extrusion process. In addition, some embodiments may include transfer members constructed from commonly available materials, including, but not limited to joists, channels, and/or troughs. For example, a furrowing channel may be used as a transfer member.

Figure 4:
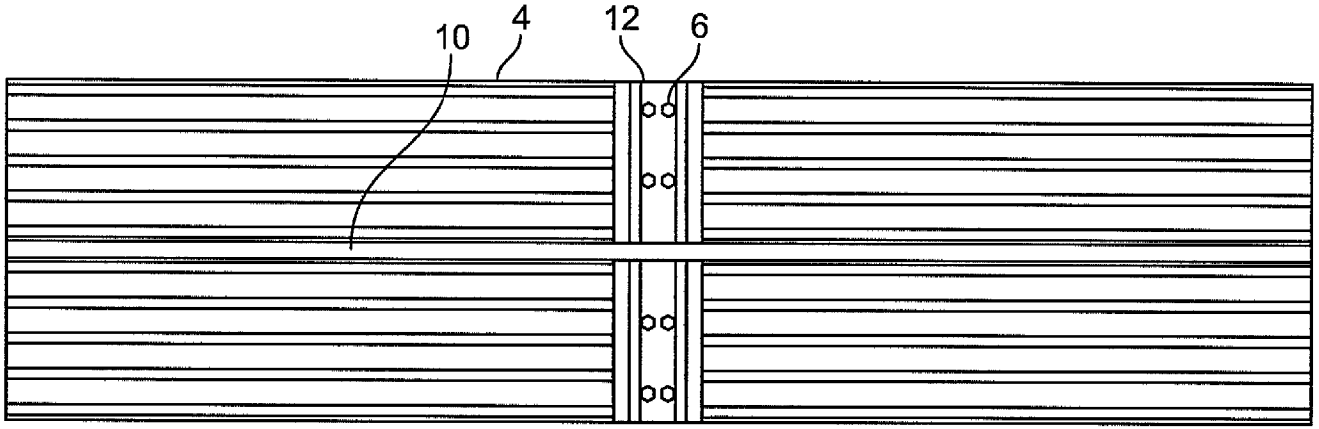
FIG. 4 depicts a top view of an embodiment of a composite floor system.
Figure 5:
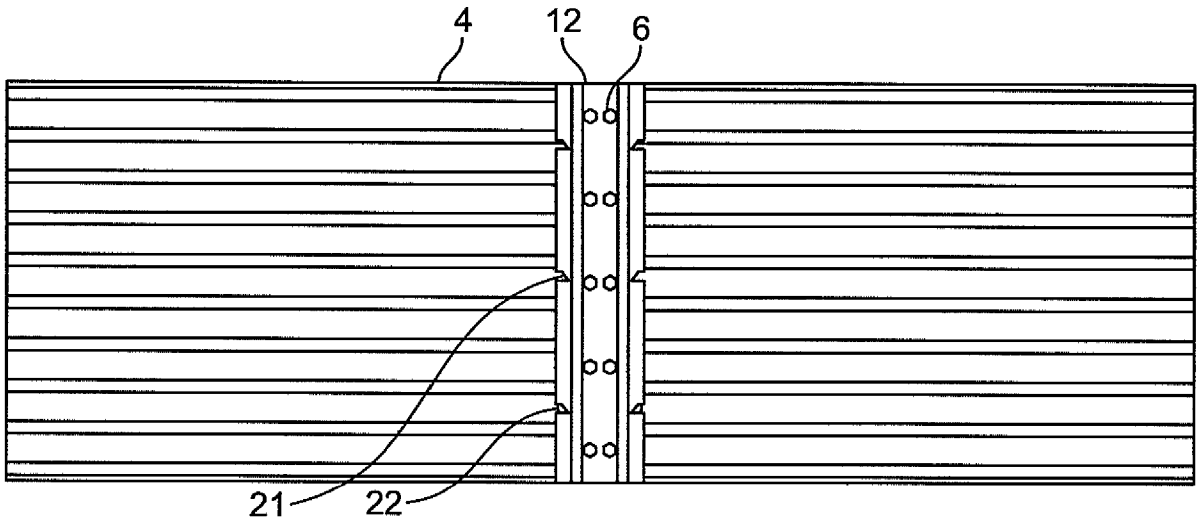
FIG. 5 depicts a top view of an embodiment of a composite floor system.

FIG. 4 and FIG. 5 illustrate a layout of fasteners 6 for coupling the transfer member 12 to decking material 4 and a support member (not shown). In some embodiments, the positioning of fasteners 6 in combination with use of the transfer member 12 may increase shear transfer from the slab to the support member 8.

Figure 6:
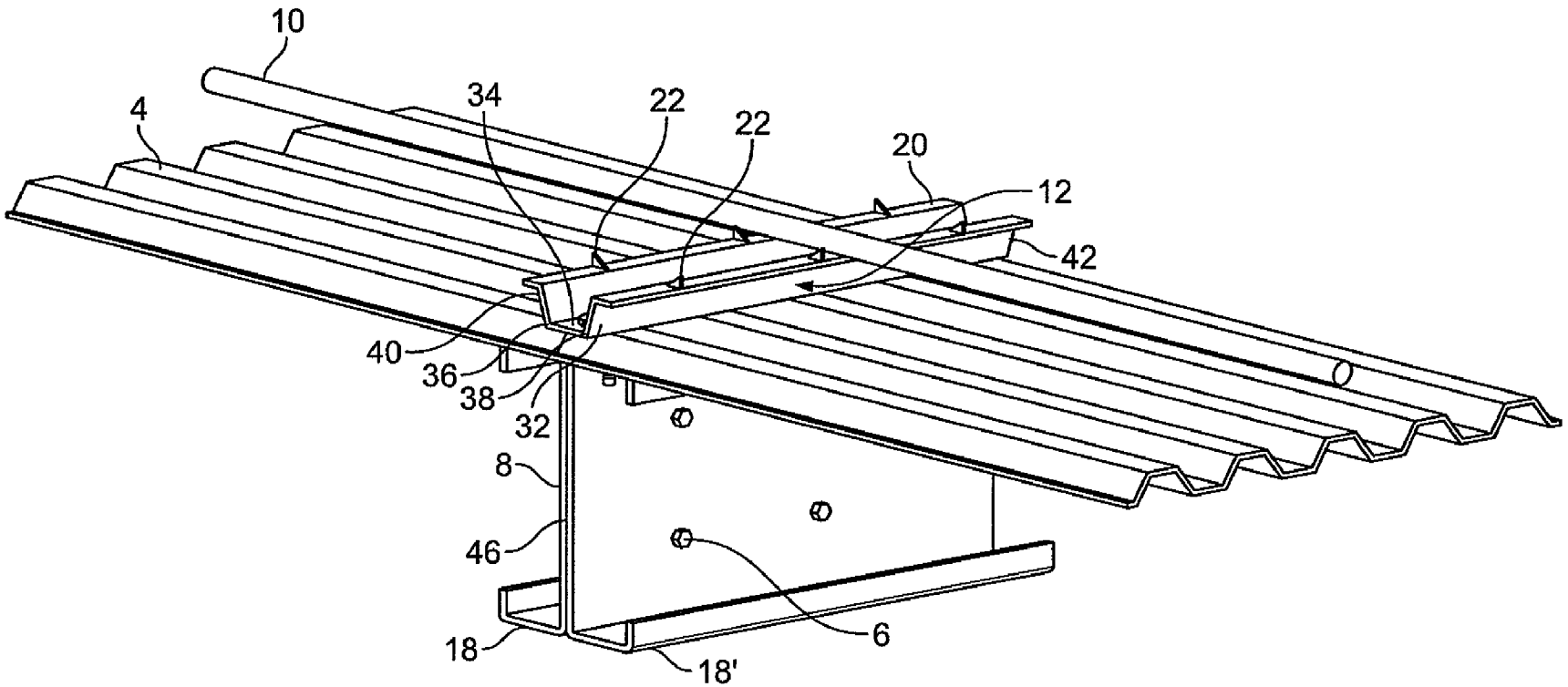
FIG. 6 depicts a perspective view of an embodiment of a composite floor system.

As shown in FIG. 5 and FIG. 6, transfer member 12 may include cuts 21 and/or folds 22. Cuts 21 and folds 22 may increase the contact area between the transfer member and the slab (not shown). In alternate embodiments, transfer member may include one or multiple protrusions or openings to increase transfer of shear forces between the slab and the support member. Openings may be punched into the transfer member on-site during assembly or prior to delivery on-site. The transfer member can facilitate in distributing the transferring mechanism of horizontal shear force. The transfer member could include a plurality of triangular cuts formed along the longitudinal axis of one flange of the transfer member. Also, the folds could be positioned along the longitudinal axis of one flange of the transfer member.

Figure 7:
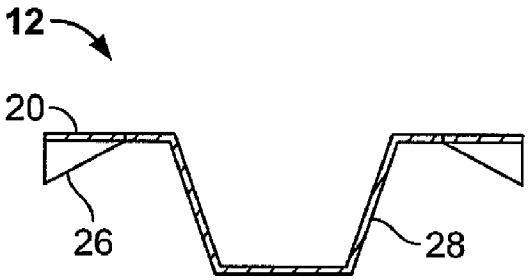
FIG. 7 depicts a cross-sectional view of an embodiment of a transfer member.
Figure 8:
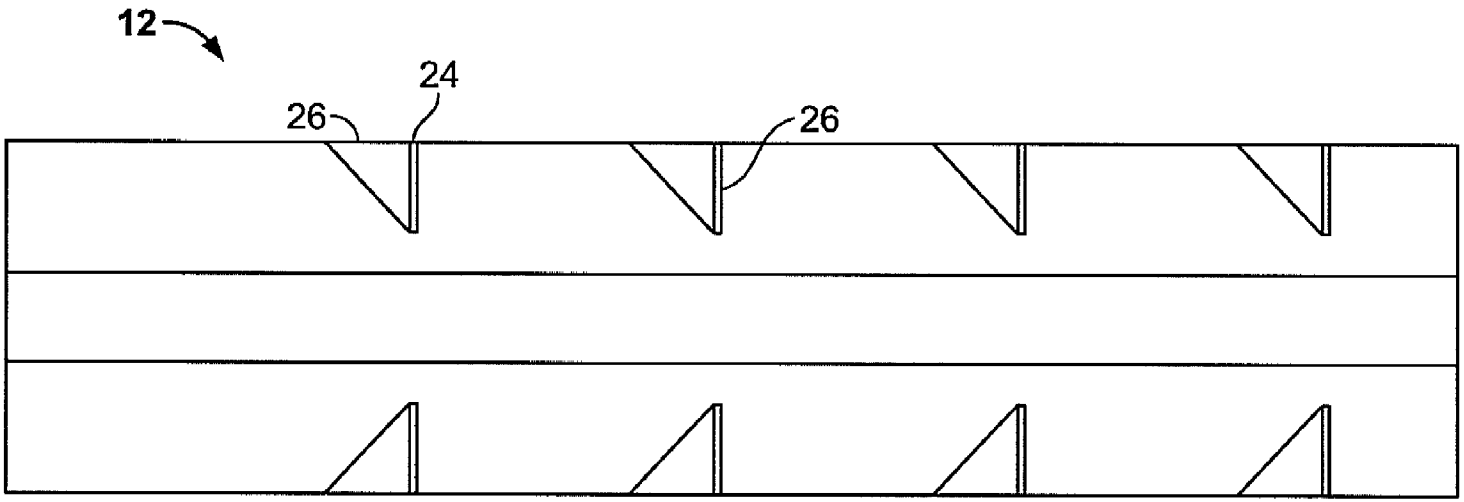
FIG. 8 depicts a top view of an embodiment of a transfer member.
Figure 9:
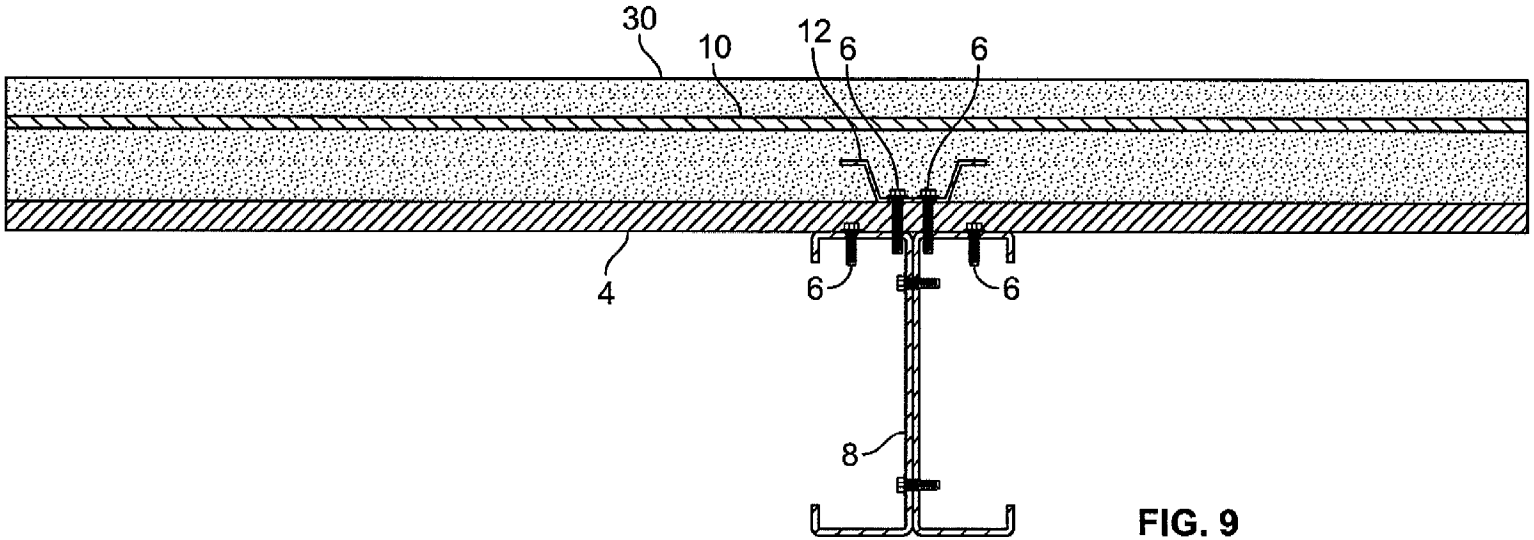
FIG. 9 depicts a cross-sectional side view of an embodiment of a composite floor system.

As shown in FIG. 7 and FIG. 8, transfer member flanges 20 include pre-cuts 24, such that portions 26 of transfer member flange 20 may be bent up or down. In some embodiments, portions 26 may have any shape. The shape of transfer member flanges 20 may vary. Transfer members may have any surface including, but not limited to a rough surface, a smooth surface, or a combination thereof. The pre-cuts could be positioned along the longitudinal axis of one flange of the transfer member so as to allow the flange to bend vertically.

FIG. 7 illustrates transfer member 12 having trough 28 and transfer member flanges 20. In alternate embodiments, a section of the transfer member may have a cross-sectional profile of a V-shape, a V-shape with a flat bottom, a U-shape, a W-shape or any other shape commonly known in the art. In some embodiments, transfer member flanges 20 are continuous along the length of transfer member 12. Alternately, transfer member flanges 20 may run for a discreet length of transfer member 12.

FIG. 9-12 demonstrate use of composite floor system 2. Slab 30 surrounds sections of transfer member 12 as shown. As shown, the slab 30 may be formed from concrete. In an embodiment, a slab may be formed from concrete, gypsum, GYP-CRETE® underlayment, a composite, fiberglass, plastic, any material that can flow and set, or any material known in the art.

In some embodiments, the transfer member 12 is coupled to the decking material 4 and support member 8 to increase transfer of shear forces between the slab 30 and the support member 8. The transfer member 12 may increase transfer of shear forces between the slab 30 and the support member 8 due to a continuous part of the transfer member 12 embedded in the slab 30. Thus, the composite floor system 2 may be able to withstand higher bending moments and sustain less deflection than expected for traditional composite systems or non-composite systems.

In an embodiment, the transfer member 12 is situated on top of the decking material 4 in the same direction as the support member 8. The transfer member 12 has a length L (see FIG. 3) that is the same or substantially the same as the width W of the decking material 4. Thus, the transfer member 12 is continuous across the top of the decking material 4.

The transfer member may be any conventional furring channel, such as the furring channel made by Allied Building Products Corp., East Rutherford, N.J. The transfer member may have any suitable height, such as a height of ⅞ inches.

With reference to FIG. 6, the transfer member 12 can include an elongated body 32 having a bottom 34 with a first edge 36 and a second edge 38 opposite the first edge 36. Also, the transfer member 12 can include an open top opposite the bottom 34, a first side wall 40 extending upwardly from the first edge 36 of the bottom 34, and a second side wall 42 extending upwardly from the second edge 38 of the bottom 34. The flanges 20 extend from each of the first and second side walls 40, 42.

Figure 10:
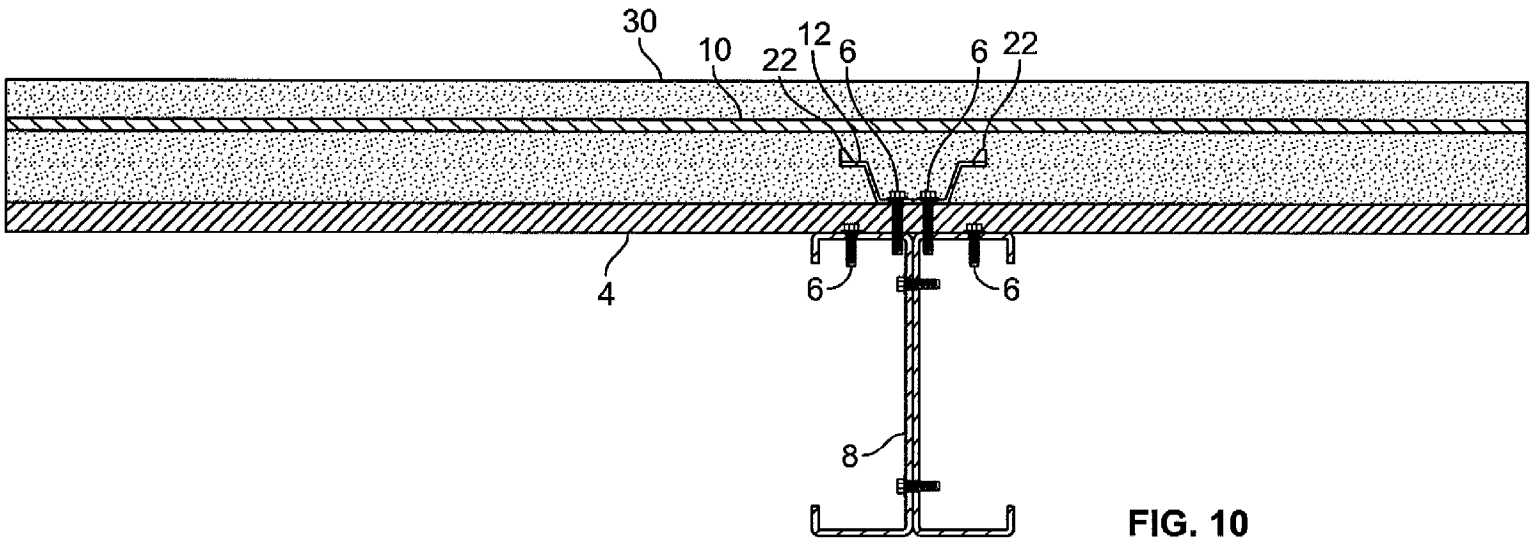
FIG. 10 depicts a cross-sectional side view of an embodiment of a composite floor system.
Figure 11:
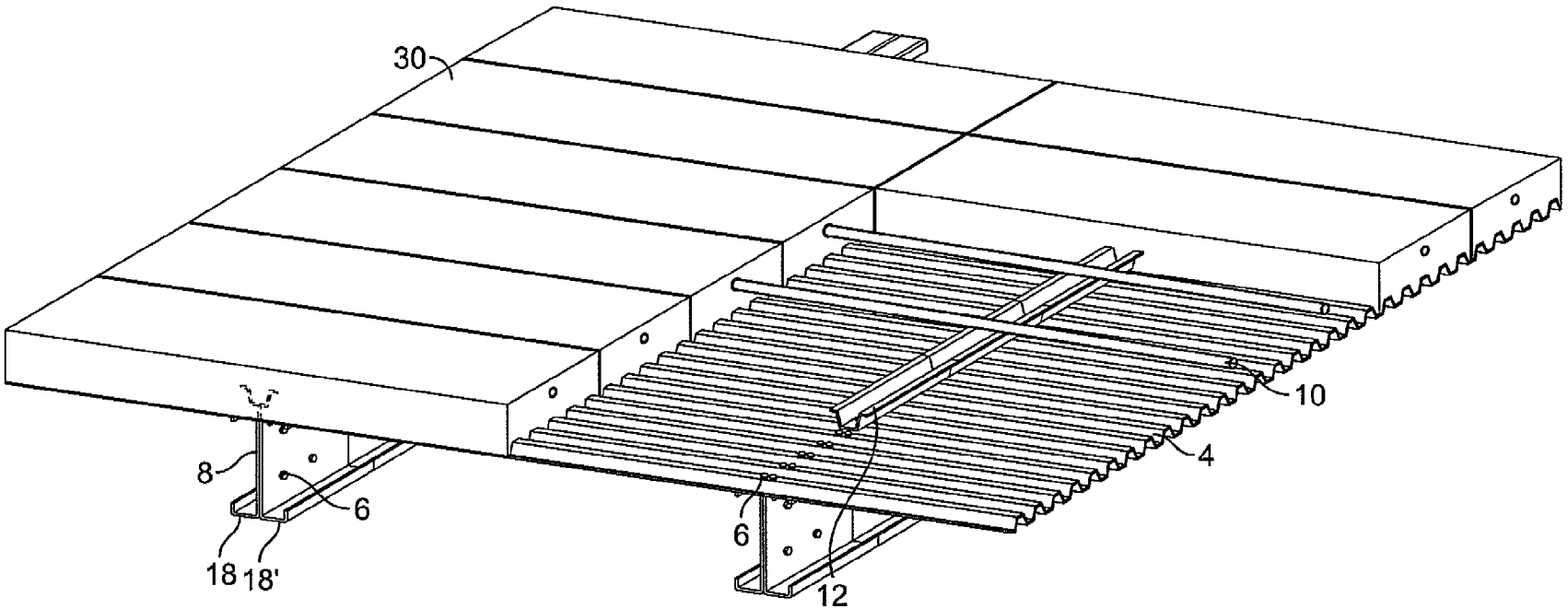
FIG. 11 depicts a perspective view of an embodiment of a composite floor system with an associated slab.
Figure 12:
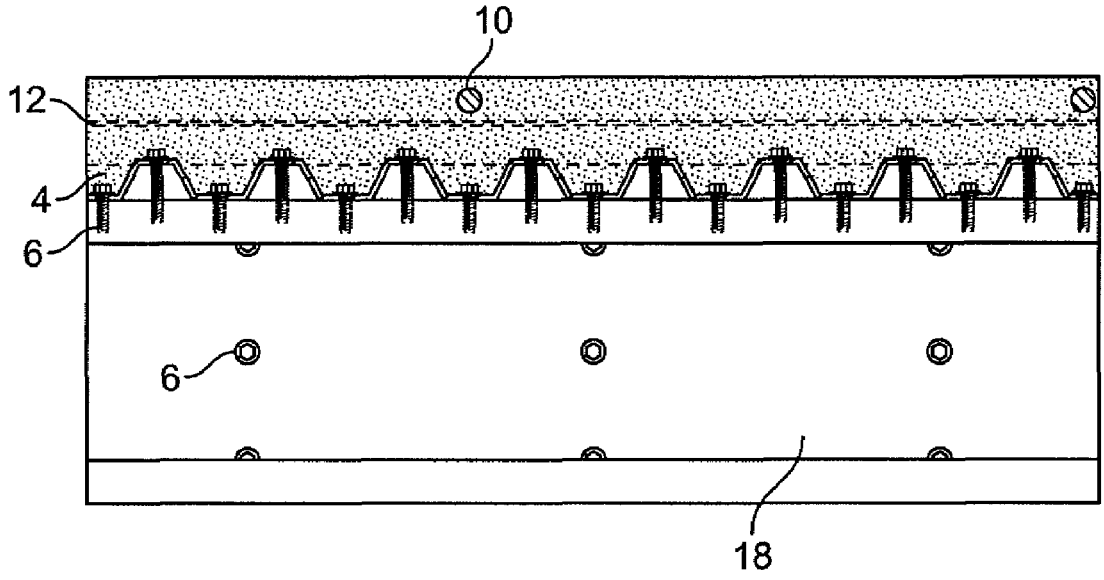
FIG. 12 depicts a cross-sectional side view of an embodiment of a composite floor system.

As shown in FIG. 10, an alternate embodiment may include a transfer member with cuts 21 and folds 22. In some embodiments, a shape of transfer member flange 20 in 20 combination with cuts 21 and folds 22 may achieve full bearing of the transfer member 12 with the slab 30. In an alternate embodiment, transfer member flanges may be shaped to allow for an increase in transfer of shear forces. For example, the shape of the transfer member flange may be irregular having wider or narrower sections. Alternately, a transfer member flange may include protrusions and/or cut-outs. Bending and deflection characteristics of the herein described composite floor system may be improved due to the described configuration when compared with non-composite floor systems.

In alternate embodiments, the reinforcing member 10 may be coupled to the slab 30 (e.g., a concrete deck) to increase shear load transfer between the slab 30 and the support member 8. The reinforcing member 10 may be coupled to the support member 8, the transfer member 12 and/or the decking material 4 while a continuous portion of the reinforcing member 10 may be embedded in the slab 30.

Figure 13:
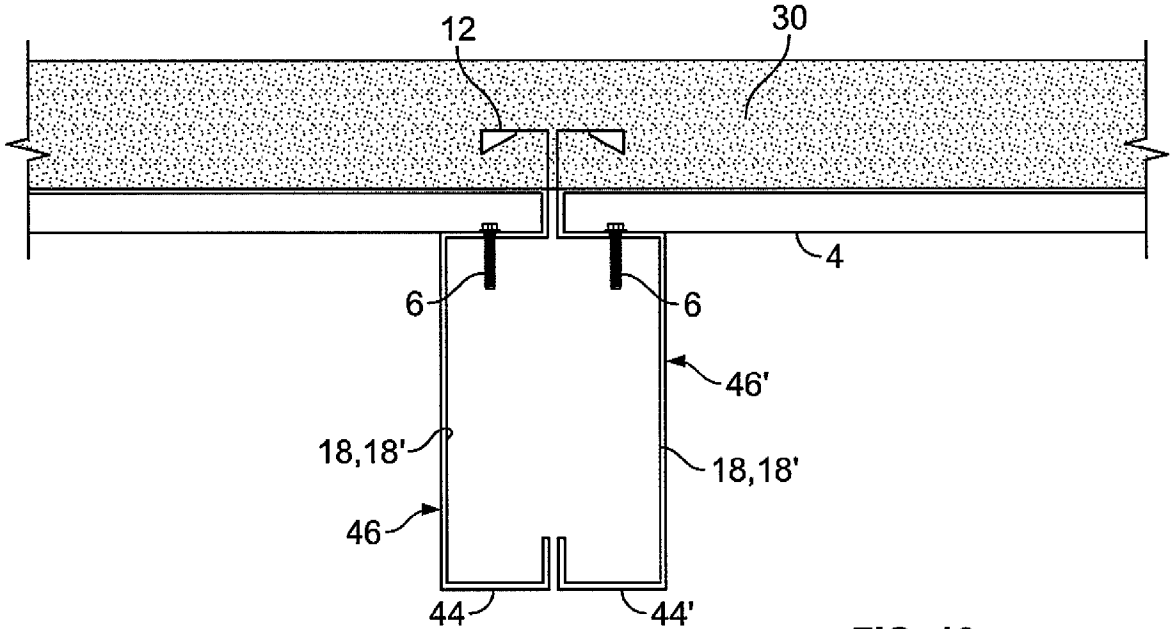
FIG. 13 depicts a cross-sectional side view of an embodiment of a composite floor system.

FIG. 13 depicts an embodiment wherein the beams 18, 18' of the support member 8 are coupled together at flanges 44, 44'. The beams 18, 18' include webs 46, 46' facing outward. The resulting cross-sectional geometry resembles a rectangle.

Figure 14:
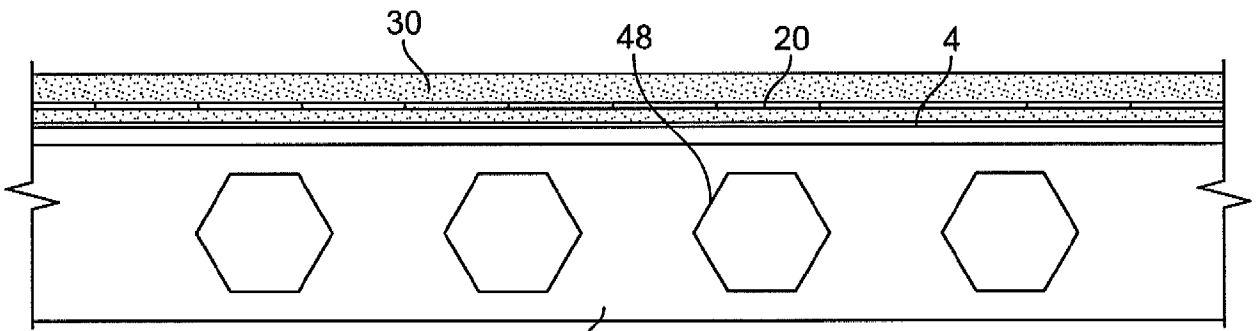
FIG. 14 depicts a cross-sectional side view of an embodiment of a composite floor system.

FIG. 14 depicts a schematic of a side view of a composite floor system. Support members 8 may include openings 48 to reduce the weight of the support member and also the composite floor system. Openings may have any shape, size, or configuration. In some embodiments, multiple openings may be positioned at intervals along the support member.

In some embodiments, component parts of the composite floor system may be coupled to each other on a construction site. For example, in some embodiments a method of constructing a composite floor system may include coupling two beams (e.g., cold-form steel beams) together with 1 inch self-drilling fastening screws using an electric impact torque wrench to form a support member. The screws may be any size or shape, such as a self-drilling fastening hex screw #10-16-¾" 0.19 inch diameter. In some embodiments, the beams may be coupled together to allow webs 46, 46' of beams 18, 18' to be positioned proximate each other as shown in FIG. 6. The top flange and bottom flanges of the two beams may be on the same plane. Screws may be positioned in two rows along a span of the beam. Each row of screws may be positioned one inch from the top flange and one inch from the bottom flange of the steel beams. In some embodiments, screws may be positioned along the beam at discrete distances from each other. For example, screws may be positioned having a one-foot spacing between the screws along the beam span.

An embodiment may include positioning a decking material, such as a cold form steel deck, on the top of the assembled support member. As shown in FIG. 3, peaks 14 and valleys 16 of decking material 4 may be positioned perpendicular to support member 8. Alternately, the peaks 14 and valleys 16 may be positioned in parallel with the support member. In some embodiments, peaks 14 and valleys 16 may be positioned such that they form an obtuse or acute angle with a vertical plane through support member 8. Proximate pieces of decking material 4, 4' may overlap as FIG. 3 illustrates. In some embodiments, overlapping decking materials may be coupled together using one or multiple fasteners. Distances between the fasteners may vary according to the application. For example, one-inch self-drilling fastening screws may be used to couple overlapped form decks spaced at one-foot intervals along the length of the deck ribs. In some embodiments, proximate pieces of decking material may be positioned such that peaks 14 and valleys 16 correspond. In some embodiments, a continuous slab may require multiple pieces of decking material.

A portion of the decking material may be coupled to a support member with any type of coupling method known in the art or described herein. For example, decking material may be coupled to a support member at a valley of decking material with screws. Alternately, decking material may be coupled to support members at any location on the decking material. In some embodiments, screws or any type of fastener may be positioned at a specific distance from a centerline of the support member (e.g., 0.25 inches from the centerline of the beam). Further, screws may be positioned along a span of the beam at regular or irregular intervals. For example, screws may be positioned along the beam span at 2.5 inch intervals. The screw can be any suitable size or shape, such as a self-drilling fastening hex screw #10-16-¾" 0.19 inch diameter.

An embodiment may include placing a transfer member on top of the decking material such that a centerline of the transfer member corresponds to a centerline of the support member. The transfer member may be coupled to the support member using fasteners. Fasteners may be positioned such that the fasteners are offset from a centerline of the support member and are positioned at intervals along the span of the support member. For example, a transfer member may be positioned on top of a steel deck and coupled with two-inch self-drilling screws. The screws may be located at 0.25 inches from the centerline of beam. The screws may be positioned at 2.5 inch intervals along the span of the beam. The screws can be any suitable size or shape, such as a self-drilling fastening hex screw #12-14-2" 0.21 inch diameter. In alternate embodiments, a centerline of the transfer member may be positioned perpendicular to a centerline of the support member. An embodiment may include positioning the centerline of the transfer member at either an acute or obtuse angle with respect to the centerline of the support member.

In some embodiments, reinforcing members may be positioned proximate the transfer member. Reinforcing members may be positioned perpendicular to the centerline of the support member. Alternately, reinforcing members may be positioned parallel to or at an acute or obtuse angle with respect to the centerline of the support member. For example, in one embodiment rebar may be used as reinforcing members and the decking material may be a steel sheet with ribs. In an embodiment, rebar may be positioned 2 inches from the bottom of a rib and perpendicular to the support member.

An embodiment may include pouring a slab into the herein described composite floor system. For example, concrete may be poured onto the decking material. The slab may have a thickness sufficient to cover decking material, a transfer member and/or a reinforcing member. In some embodiments, a thickness of the slab may be approximately 3 inches. In some alternate embodiments, the thickness of a slab may vary according to the requirements of the application. In some embodiments, a slab may be covered after being poured to minimize water evaporation to allow the slab to cure.

In an embodiment, portions of a composite floor system as herein described may be pre-fabricated prior to delivery to the site. Pre-fabrication of portions of the composite floor system may reduce building costs on-site as well as provide for a more consistent quality in the building process. For example, decking material may arrive on a construction site coupled to a transfer member. Pre-fabrication may allow for more consistent coupling of the component parts, whether the method of coupling is a screw, a bolt, a rivet, a weld (e.g. a spot-weld), a nail, a strap, or any other method of coupling known in the art. Alternately, reinforcing members may be coupled to decking material and transfer members prior to delivery to the site. Further, support members may be formed prior to delivery on-site. For example, two beams may be coupled together to form a support member prior to delivery on-site.

Figure 15:
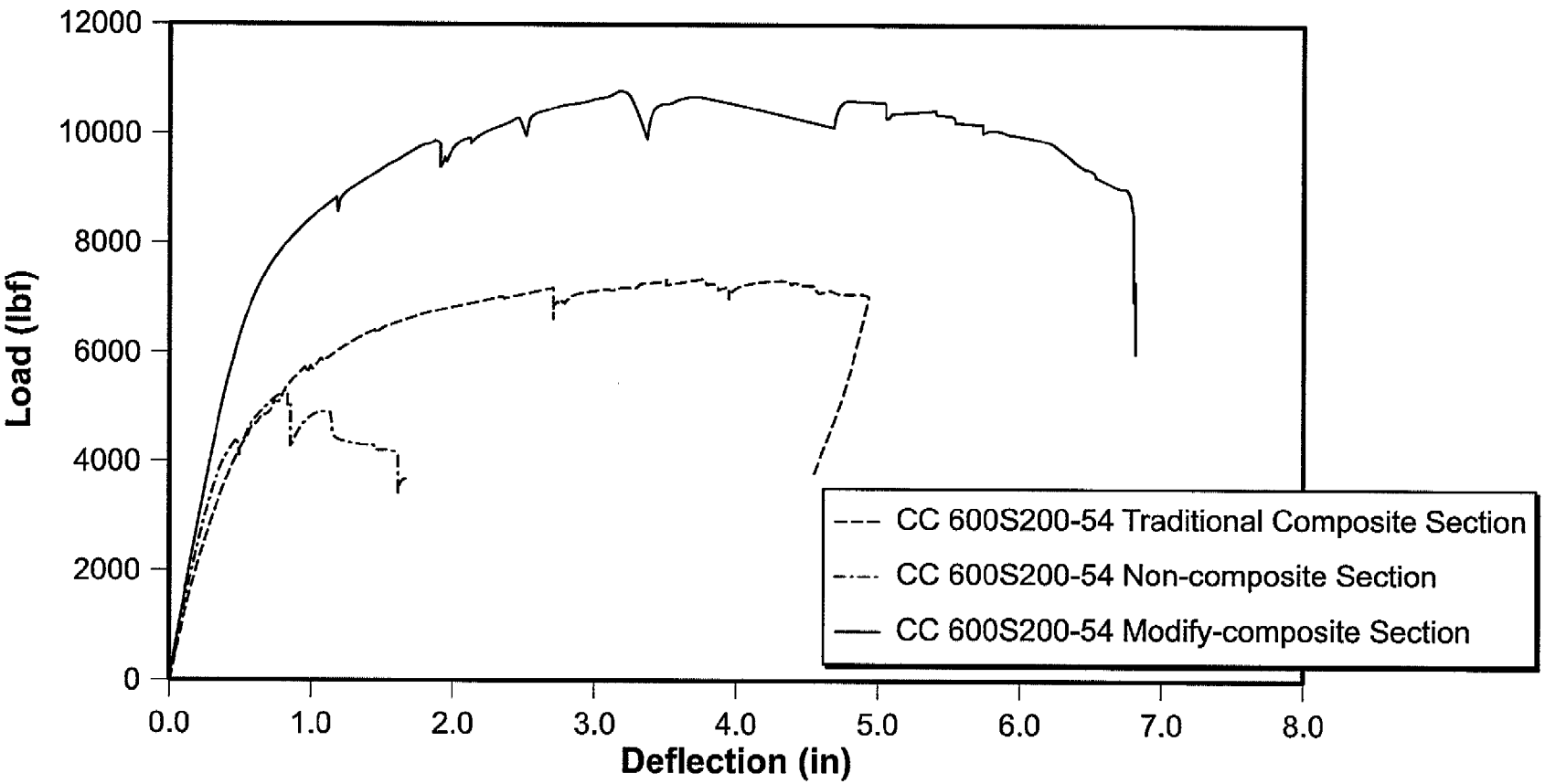
FIG. 15 is a schematic depicting the load deflection values for a composite floor system, a non-composite floor system, and a modified composite floor system.
Figure 16:
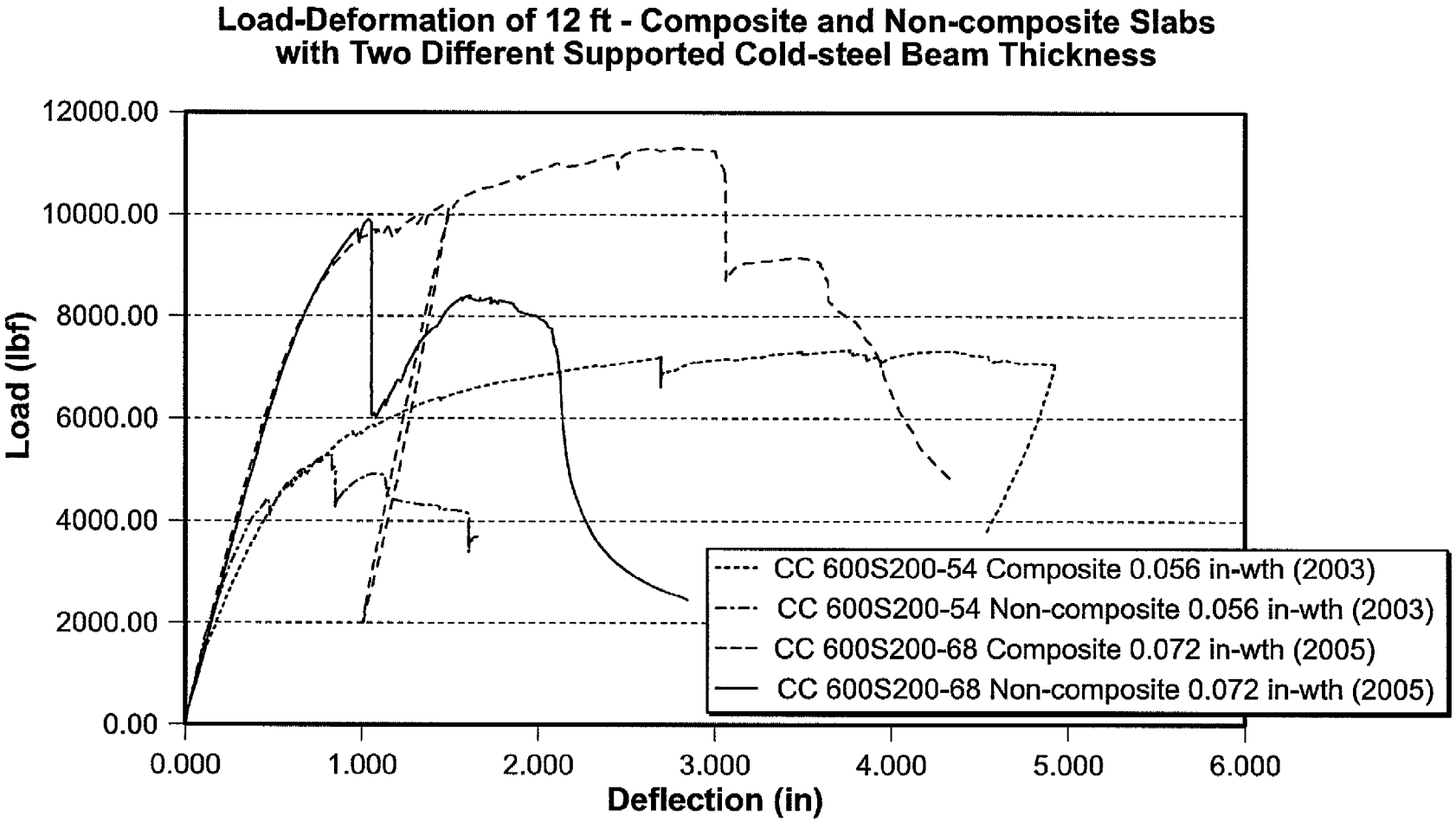
FIG. 16 is a schematic depicting the load deflection values for composite floor systems and non-composite floor systems having support members of different thicknesses.
Figure 17:
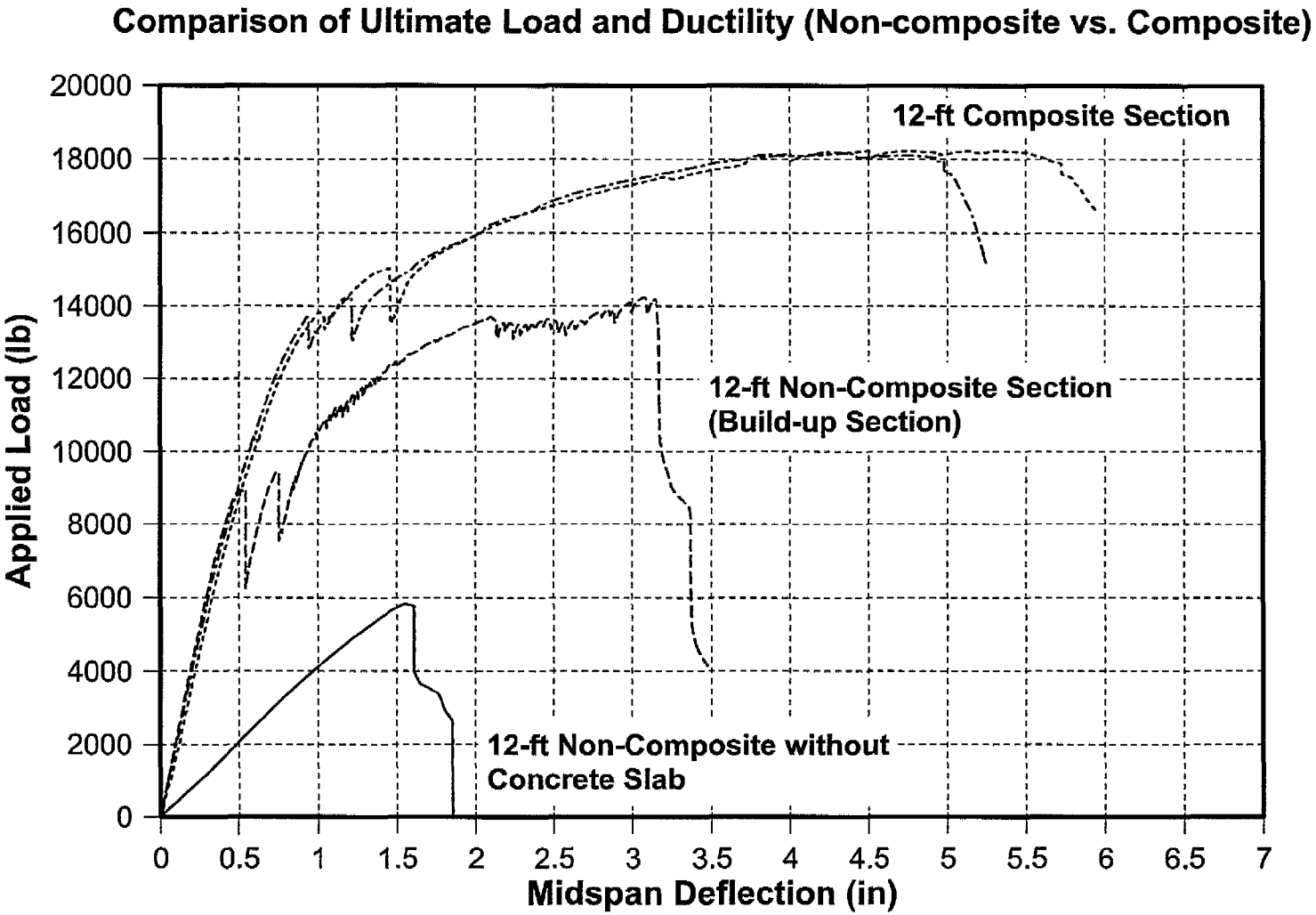
FIG. 17 is a schematic depicting the midspan deflection values for a composite floor system and a non-composite floor system.

The method and system described herein provides a composite floor system, which in some embodiments, may be constructed from readily available material and using readily available tools. The combination of components in the composite floor system provides for a strong, resilient and ductile floor system. The symmetry in the design of the composite floor system may allow the floor system to withstand larger forces and increase the ductility of the system described herein over floor systems commonly known in the art. FIG. 15 depicts a graph of applied load to deflection for a traditional composite system, a non-composite system, and a composite floor system as described herein. As is evidenced in the graph, the composite system described herein can withstand large loads and sustain smaller deflections than comparable traditional composite or non-composite floor systems. FIG. 16 depicts a graph of applied load to deflection values measured for the herein described system and method and a non-composite floor system having varied support member thicknesses. From the data presented in the graph, it appears that the composite floor system and method described herein may withstand greater applied loads than comparable non-composite floor systems. FIG. 17 depicts a graph of applied load to midspan deflection values measured for a composite floor system as described herein and a non-composite floor system. According to the data presented in the graph of FIG. 17, the composite system described herein can withstand greater applied loads and has greater ductility than comparable non-composite floor systems.

The composite system described herein is a scalable entity. The dimensions of the components of the composite system can be altered.

The following description will describe a method for assembling the composite system 2. Initially, two cold-formed steel joists, such as the C-beams 18, 18', are attached to each other with 1 inch (25.4 mm) self-drilling fastening screws using an electric impact torque wrench. More particularly, the screws are positioned at one row approximately one inch from the top web, and at another row approximately one inch from the bottom web. Each row has one foot spacing along the beam span.

A cold-formed steel decking material is placed on the top of the beams such that the decking material 4 is perpendicular to the beams. 1 inch (25.4 mm) self-drilling fastening screws are used to connect portions of the decking material that overlaps with other portions of the decking material 4. The rib of the decking material is fastened to the beams with two 1 inch self-drilling screws. Each screw is located at 0.25 inches (6.35 mm) from the centerline of the beam. The next set of screws is located at 2.5 inches (63.5 mm) from the first set of screws or the spacing of the bottom rib of the decking material. The remaining screws are placed following the above series along the beam span.

The shear connector, such as the transfer member 12, is placed on top of the decking material 4. The location of the shear connector should be on the center line of the beam. The shear connector is fastened to the beam with two 2 inch (50.8 mm) self-drilling screws. Each screw is located at 0.25 inches (6.35 mm) from the centerline of beam. The location of the next set of screws is designated by the spacing of the top rib of the decking material 4 or 2.5 inches (63.5 mm) along the beam span.

A number 2 or 3 rebar, such as the reinforcing member 10, is placed on the shear connector to prevent transverse cracking in the slab. The rebar is located 2 inches (50.8 mm) from the bottom rib. The direction of the rebar is perpendicular to the beam span. The rebar is spaced one foot along the span.

3 inches thick (76.2 mm) concrete is then placed on the decking material. The concrete is immediately covered after casting to avoid any water evaporation.

Applicants have attempted to disclose all embodiments and applications of the disclosed subject matter that could be reasonably foreseen. However, there may be unforeseeable, insubstantial modifications that remain as equivalents. While the present invention has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

What is claimed is:

1. A composite floor system comprising:

a slab;

a deck material sized and shaped to support said slab;

a support member attached to said deck material; and a transfer member attached to said deck material and said support member, said transfer member including an elongated body having a bottom with a first edge and a second edge opposite said first edge, a first side wall extending upwardly from said first edge of said bottom, and a second side wall extending upwardly from said second edge of said bottom, said transfer member sized and shaped to increase transfer of shear forces between said slab and said support member.

2. The composite floor system of claim 1, wherein said deck material has a width, and said transfer member has a length substantially the same as the width of said deck material.

3. The composite floor system of claim 2, wherein said transfer member includes a first flange extending from said first side wall, and a second flange extending from said second side wall.

4. The composite floor system of claim 3, wherein said transfer member includes a plurality of triangular cuts formed along a longitudinal axis of said first flange.

5. The composite floor system of claim 4, wherein said transfer member includes a plurality of folds positioned along a longitudinal axis of said first flange.

6. The composite floor system of claim 3, wherein said transfer member includes a plurality of pre-cuts positioned along a longitudinal axis of said first flange so as to allow said first flange to bend vertically.

7. The composite floor system of claim 1, wherein said transfer member is a light gauge furring channel made of steel.

8. The composite floor system of claim 7, wherein said transfer member is cold-formed.

9. The composite floor system of claim 1, wherein said transfer member is positioned relative to said support member such that said transfer member is parallel to said support member and perpendicular to said deck material.

10. The composite floor system of claim 9, wherein said transfer member is embedded in said slab such that said slab substantially surrounds said transfer member.

11. The composite floor system of claim 10, wherein said body of said transfer member has a length and a width, said body being elongated such that the length is substantially greater than the width.

12. The composite floor system of claim 11, wherein said support member includes a first beam having a first side wall and a second beam having a second side wall, said first side wall positioned proximate to said second side wall.

13. The composite floor system of claim 12, wherein said first beam and said second beam are substantially C-shaped.

14. The composite floor system of claim 13, further comprising a reinforcing bar positioned on said transfer member, said reinforcing bar being perpendicular relative to said transfer member, said reinforcing bar sized and shaped to prevent transverse cracking in said slab.

15. The composite floor system of claim 1, wherein said deck material is a corrugated sheet metal having peaks and valleys.

* * * * *